US005271807A

United States Patent [19]

Kinzler

[11] Patent Number: 5,271,807

[45] Date of Patent: Dec. 21, 1993

[54] HEADBOX WITH PROFILE BAR MEASURING DEVICES

[75] Inventor: Gernot Kinzler, Heidenheim, Fed. Rep. of Germany

[73] Assignee: J.M. Voith GmbH, Heidenheim, Fed. Rep. of Germany

[21] Appl. No.: 930,400

[22] PCT Filed: Jan. 31, 1992

[86] PCT No.: PCT/EP92/00208

§ 371 Date: Sep. 8, 1992

§ 102(e) Date: Sep. 8, 1992

[87] PCT Pub. No.: WO92/13995

PCT Pub. Date: Aug. 20, 1992

[30] Foreign Application Priority Data

Feb. 4, 1991 [DE] Fed. Rep. of Germany ..... 4103259

[51] Int. Cl.[5] ..... D21F 1/02

[52] U.S. Cl. ..... 162/262; 162/263; 162/344; 162/347

[58] Field of Search ..... 162/336, 344, 347, 259, 162/262, 263

[56] References Cited

U.S. PATENT DOCUMENTS 4,342,619 8/1982 Gladh ..... 162/262
4,406,740 9/1983 Brieu ..... 162/259
4,517,055 5/1985 Dove ..... 162/347
4,680,089 7/1987 Aral et al. ..... 162/259
4,770,744 9/1988 Dove ..... 162/259
4,783,241 11/1988 Egelhof ..... 162/347

OTHER PUBLICATIONS

Voith Brochure P2503, Mar. 1982.

*Primary Examiner*—Karen M. Hastings
*Attorney, Agent, or Firm*—Baker & Daniels

[57] ABSTRACT

A headbox includes a nozzle type stock channel with an outlet gap. The nozzle type stock channel is defined by two flow guide walls. Arranged on the discharge end of the upper flow guide wall is a movable aperture to which attach numerous adjustment spindles which are arranged distributed across the machine width. Each adjustment spindle has on its end away from the aperture a spindle drive. Provided on the upper end of each spindle is a measuring device serving the determination of the local position of the aperture. The measuring device has a measuring housing and a measuring element movable in it. The measuring element is connected positively with the aperture, independently of the spindle, by way of a measuring rod. The measuring housing is positively connected with the area of the flow guide wall on the near side of the aperture, by way of an oblong tubular measuring reference.

17 Claims, 2 Drawing Sheets

HEADBOX WITH PROFILE BAR MEASURING DEVICES

BACKGROUND OF THE INVENTION

The invention concerns a headbox for a machine for the production of fiber material webs, for instance paper webs, and, more particularly, to a headbox having a slot connected to measuring devices determining the local position of the slot. Such headboxes are known from the Voith brochure "Headboxes" No. p 2503. A headbox of that type has two flow guide walls; these converge to each other in flow direction, thus forming (together with side walls) a nozzle type machinewide stock channel which features a machinewide stock outlet gap. At least one of the two flow guide walls is movable or has a movable part, whereby a coarse adjustment of the clearance of the stock outlet gap can be effected.

Additionally available yet is an arrangement for fine adjustment of the outlet gap clearance, namely in the form of a slat which extends on one of the two flow guide walls (for example on the movable flow guide wall) along the stock outlet gap across the entire machine width, and which relative to this flow guide wall is transverse to the direction of outflow adjustable and locally deformable. More exactly: the aforementioned flow guide wall is subdivided in a stiff major part and the adjustable and locally deformable slat. This stiff major part may be a rigid, i.e., immovable part of the headbox or may be fashioned as the aforementioned flow guide wall which is movable relatives to the remaining headbox (or a movable flow guide wall part).

For adjustment of the said slat there are numerous adjustment spindles provided which are arranged distributed across the machine width. Each of these adjustment spindles is individually movable along its axis by means of a spindle drive. Thus, a small local deformation can be imparted to the slat by means of each individual one of the numerous adjustment spindles. Of course, it is also possible to operate several adjacent adjustment spindles simultaneously. The objective is normally to adjust the clearance of the discharge gap as much as possible exactly alike across the machine width so that, as the final result, the paper web produced on the machine will obtain maximally constant propertiesacross the machine width (particularly a constant basis weight). But sometimes it may also be desirable to cause at a specific point of the web width, for instance at the edges, deliberately a variation from the normal web properties by adjustment of individual spindles. Exceptionally it may happen that all of the adjustment spindles are actuated at the same time, in order to adjust the slat uniformly across the entire machine width.

The said slat may be fashioned differently., preferably it is designed as a so-called profile bar which has the shape of a ruler and is arranged on the outlet end of the respective flow guide wall (that is, on the said stiff major part of the flow guide wall). Such a profile bar—viewed in longitudinal section through the headbox—is adjustable transverse to the longitudinal expanse of the flow guide wall and locally deformable.

Another embodiment of the movable slat may be realized in that the outlet end of the respective flow guide wall is by way of a thin spot connected with the stiff major part of the flow guide wall. In this case, the outlet end of the flow guide wall may itself be adjusted or locally deformed.

Besides these known features, the following can be seen yet from the aforementioned Voith brochure: to make it possible—at any time during the operation—to read along the entire length of the slat its local position, there are numerous measuring devices provided which are distributed across the machine width. Illustrated is a preferred embodiment where each of the adjustment spindles features on its end away from the slat such a measuring device. According to photograph 9, the measuring devices are designed as preferably mechanical measured value indicators. According to photograph 5, a so-called "path pickup" is provided additionally on each spindle. This is a measuring device fashioned as an electrical signal emitter. The entirety of these signal emitters serves the remote indication of the position, respectively the state of deformation of the said slat and additionally—as required—the transfer of appropriate data to a process control system which, among others, controls the adjustment spindle drives in a way such that the paper web will obtain the desired basis weight cross profile.

While the prior headboxes have proved themselves in practice, it has nonetheless been found that the accuracy of the measurement of the position, respectively of the state of deformation of the said slat, is with the prior arrangement of the measuring devices not sufficient in all cases.

SUMMARY OF THE INVENTION

Therefore, the problem underlying the invention is to provide measures by which in the initially described headboxes the accuracy of the measurement of the position and of the state of deformation of the slat can be improved further.

SUMMARY OF THE INVENTION

The present invention provides movable measuring elements positively connected to the slot independently of the adjustment spindles, by a measuring rod. Each measuring housing is positively connected with the area of the stiff major part of a flow guide wall which is close to the slat by means of an oblong linkage element, i.e., measuring reference, extending parallel to the measuring rod.

Among others, the invention is based on the result of a difficult and time-consuming study of the causes of the measuring inaccuracies observed so far. In the process, allowance had to be made for the fact that, e.g., the mechanical measured value indicators heretofore were arranged as follows: Their stationary housing is borne by the housing of the spindle drive, which, in turn, is mounted on the stiff major part of the respective flow guide wall (according to photograph 5 of the said Voith brochure, the respective flow guide wall is reinforced by a so-called upper lip beam). What's more, the movable measuring element of the measuring setup bears positively on the spindle end away from the slat. In other words, the momentary position of the respective part of the slat can be communicated to the measuring device only via the spindle.

Therefore, a measuring error frequently comes about because some of the adjustment spindles are under traction stress whereas others are stressed by thrust. The cause of these stresses is the deformation resistance of the slat. It may also happen that in one or several adjustment spindles the state of stress changes from traction to thrust or conversely. In other words: the adjustment spindles of a headbox are during operation subjected to different and changing elastic deformations in the form of length changes. Similar elastic deformations may occur, for instance in the housings of the spindle drives or in the respective flow guide wall or in the stiffening beam pertaining to it. All of these mechanical deformations and thermal deformations possibly adding to it adulterate the result of the measurement of the local position of the slat.

Known from U.S. Pat. No. 4,342,619 is a headbox on the outlet gap of which there is again provided an adjustable and locally deformable slat (15) fashioned as a ruler type profile bar. Provided at an only slight distance from the outlet gap are numerous measuring devices (21) distributed across the machine width and fashioned as electrical signal emitters. Each of these measuring devices has a movable measuring element (23) which independently from the adjustment spindles (17) is positively connected with the slat (15) through a measuring rod (23*a*). Each measuring device comprises additionally a measuring housing (22) which is positively connected with the stiff part (12*a*) of the flow guide wall (12). With this prior device it may perhaps be mastered to obtain relatively accurate measured values concerning the local position of the slat (15). But one difficulty is that protecting the measuring devices from contamination or occasional flooding will not be mastered with one hundred percent safety. The measuring devices will be shrouded though with the aid of a cover, but the latter cannot durably be kept tight in view of the movability of the slat (15). The application of such a measuring device located near the outlet gap thus had to be abandoned again.

The invention is now based on the insight that an arrangement of the measuring devices away from the slat needs to be retained and that the following needs to be provided for boosting the measuring accuracy:

1. The movable measuring element of each measuring device (as known from the already mentioned U.S. Pat. No. 4,342,619) must be positively connected with the slat, independently of the adjustment spindles, by way of a separate measuring rod. This eliminates the disturbing influence of the changing state of stress on the adjustment spindles in the transfer of the measured quantity.

2. The measuring housing of each measuring device must not be connected with a part of the respective flow guide wall away from the slat (or, as the case may be, a pertaining reinforcement beam).

Instead, by way of an oblong link extending parallel to the measuring rod, the measuring housing must be connected to the area of the flow guide wall (more exactly: to the area of the stiff major part of the flow guide wall), which area is near the slat. The said link will hereafter be called "measuring reference," because it provides the correct reference quantity to the measuring device. Essential is that the oblong measuring reference will be connected only with that area of the stiff major part of the flow guide wall which is near the slat. The measuring housing is thus connected to the flow guide wall only via the oblong link. This makes it independent of local elastic deformations of the flow guide wall or reinforcement beam across its entire length and, as the case may be, of elastic deformations of the spindle drive housings. Eliminated are thus all of those measuring errors which so far were caused by such deformations (due to changes of the load state or due to local temperature fluctuations).

The invention is applicable with many different headbox designs. Unessential is, e.g., whether the direction of outflow through the outlet gap is horizontal or downwardly or upwardly inclined to the horizontal. Also a vertical, preferably upwardly directed direction of outflow is possible. If one of the two flow guide walls features a movable part (which will be true in the very most cases), this part may be pivotably mounted in a joint, or it may be movable obliquely to the direction of discharge. In some headboxes, this part is both movable and pivotable. The slat provided for fine adjustment of the outlet gap clearance may be fashioned, as already mentioned above, as a movable ruler type profile bar or as the bendable outlet end of one of the two flow guide walls. If according to U.S. Pat. No. 4,783,241 a movable profile bar is combined with a bendable outlet end of a flow guide wall, the inventional measuring devices are coordinated with the profile bar.

The measuring devices of the inventional headbox may be arranged spatially separated from the adjustment spindles, modeled on U.S. Pat. No. 4,342,619. In this case it is possible that the number of measuring devices varies from the number of adjustment spindles. Preferably, however, the number of measuring devices is kept equal to the number of adjustment spindles, the same as heretofore. Also retained will preferably be the prior characteristic whereafter the individual measuring device is arranged coaxially with the pertaining adjustment spindle. Resulting thereof is an important constructive idea of the invention, whereafter the measuring reference and the measuring rod extend through the interior of the now tubular adjustment spindles and preferably also through the interior of the spindle drive. Also the oblong measuring reference is preferably of a tubular design, so that the measuring rod can extend through the interior of the measuring reference.

The invention is applicable with headboxes featuring exclusively measuring devices arranged on the spindles and fashioned as (preferably mechanical) measured value indicators. But the invention is also applicable when the headbox exclusively features measuring devices fashioned as electrical signal emitters for a remote display.

But preference is given to providing in customary fashion on each adjustment spindle both a measured value indicator (for direct reading of the measured values) and an electrical signal emitter (for remote display and/or data transfer to a computer).

This offers the advantage that the electrically measured data may at any time be checked by the mechanical measured value indicator and that the headbox may continue to be operated also in the case of a failure of the electrical measurement, with the aid of the mechanical measured value indicator. But it is also conceivable to use electrical systems both for the local measured value display and for data remote transmission.

According to an as well important constructive idea of the invention, the electrical signal emitter is arranged on each adjustment spindle between the spindle drive and the mechanical measured value indicator. The electrical signal emitter is in this case located at a point which can be protected extremely well against interference effects (for instance contamination). Conceivable is providing a common housing for the electrical signal emitter and the mechanical measured value indicator. Expectations are at any rate that the electrical signal emitter will with considerably greater certainty withstand the harsh continuous operation of a paper machine than if arranged according to photograph 5 of the Voith brochure p 2503.

The accuracy of the measured value determination can be still further elevated by eliminating those disturbances which can be caused by thermal length changes of the measuring rods and measuring references. For that purpose, e.g., the measuring rods and measuring references are suitably made of materials having same thermal expansion coefficients (preferably of the same material). Besides, it is favorable to retain the measure described hereafter and previously known: the adjustment spindles—and thus also all of the measuring rods and measuring references—are arranged within a closed space which is kept isothermal. This space is formed preferably by the interior of the aforementioned box type reinforcement beam of the respective flow guide wall. In this way, temperature differences occurring now and then in the vicinity of the paper machine cannot have a negative effect on the measurement.

BRIEF DESCRIPTION OF THE DRAWINGS

An embodiment of the invention will be described hereafter with the aid of the drawing.

DETAILED DESCRIPTION OF THE INVENTION

Figure 1:
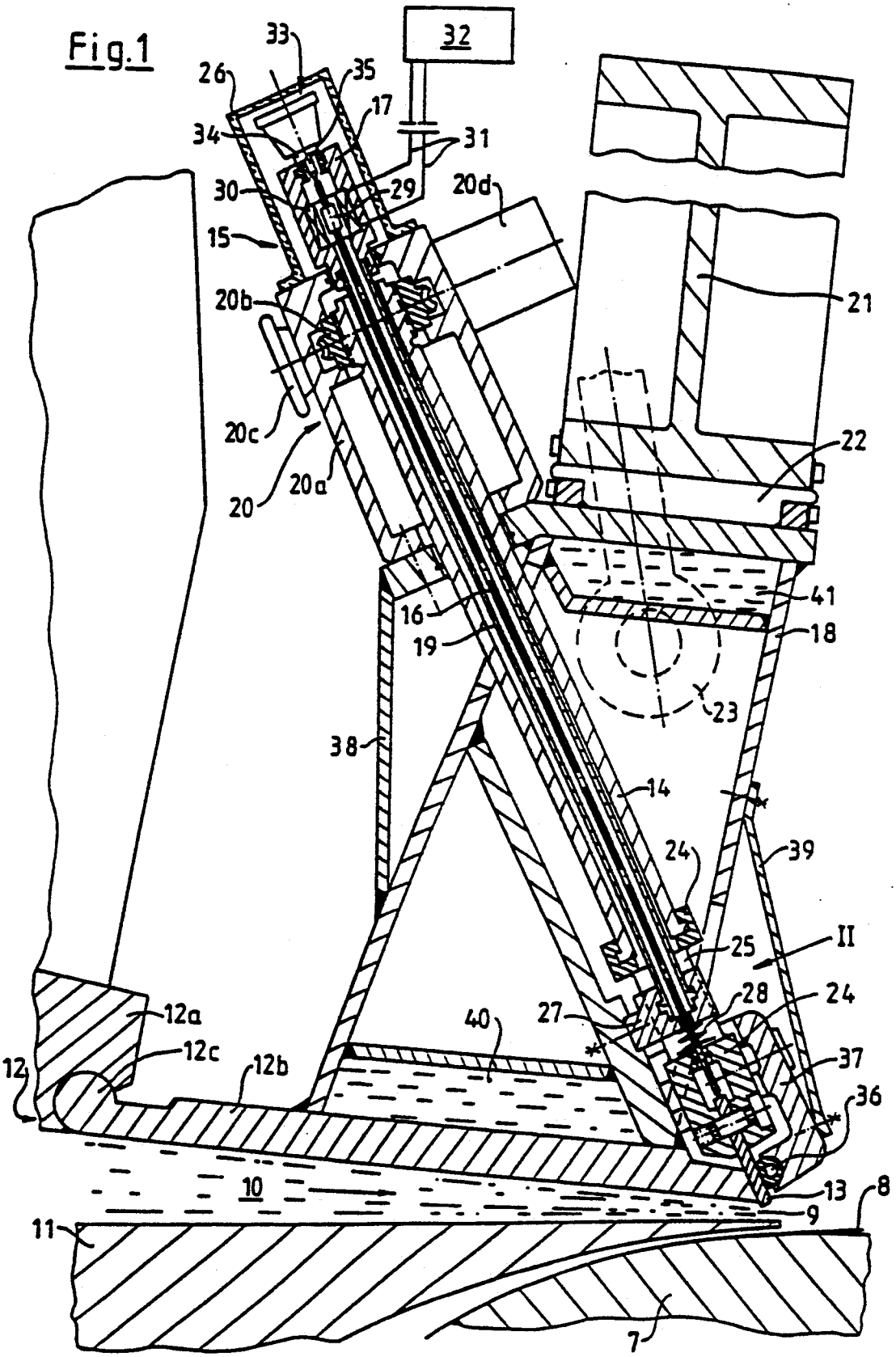
FIG. 1 is partial longitudinal section of a headbox.

The illustrated headbox has two flow guide walls 11, 12 converging to one another and defining a nozzle type, machinewide stock channel 10, which ends in a machinewide stock outlet gap 9. The discharging paper stock proceeds in the usual manner onto a paper machine wire 8 running over a breast roll 7.

The lower (in the illustrated example) flow guide wall 11 is an integral part of the stationary headbox housing. The upper flow guide wall 12 comprises an as well stationary part 12*a*, a movable but stiff major part 12*b* (connected with the part 12*a* through a joint 12*c*) and a ruler-shaped slat, hereafter called "profile bar" 13. For reinforcement, the major part 12*b* is welded to a hollow reinforcement beam 18. The latter is in known fashion connected with a flexible beam 21. Contained between the two beams 18 and 21 is a pressure cushion 22, with the aid of which the movable major part 12*b* of the flow guide wall 12, along with the reinforcement beam 18, can be kept nonsagging. It needs to be taken into account that all of the components 11, 12, 13, 18, 21 and 22 mentioned so far extend perpendicularly to the drawing plane across the entire machine width and, thus, may have a length of up to 10 m. Attached to the two ends of the reinforcement beam 18 is a lift device 23 each, for the coarse adjustment of the clearance of the outlet gap 9.

Provided for the fine adjustment of the outlet gap 9 is the said ruler-shaped profile bar 13. It is adjustable transverse to the flow direction, in the illustrated example obliquely from the top down. If needed, it can be adjusted in its entirety. But mostly it is adjusted only by a local deformation, namely by amounts which may be smaller than 1/100 mm.

For that purpose, the profile bar 13 is positively connected to numerous adjustment spindles 14, 14', 14'' (FIG. 2) arranged distributed across the machine width; the positive connection is effected by a so-called spindle foot 24 in which a window 25 is provided. Each of the adjustment spindles 14 extends diagonally through the reinforcement beam 18 and is provided at its upper end with a spindle drive 20. The latter comprises in known manner a gear casing 20*a*, mounted on the reinforcement beam 18, and a worm gear 20*b* mounted rotatably in it, the not visible worm of which can be driven by means of a handwheel 20*c* and/or a motor 20*d*. The rotation of the worm gear 20*b* generates by means of a threading a longitudinal displacement of the spindle 14 and thus a corresponding local deformation of the profile bar 13. The motor 20*d* may be a stepper motor; the smallest possible stroke of the spindle will then be 3/1000 mm.

During operation, the local position of the profile bar 13 (or in other words: the state of deformation of the profile bar) must be continuously monitored on each spindle 14. For that purpose, the position of the profile bar 13 is measured on each spindle 14 relative to the area of the reinforcement beam 18 on the near side of the profile bar, and thus the stiff major part 12*b* of the flow guide wall 12. A measuring device 15 serving that purpose is arranged above the gear casing 20*a*. It is easily accessible there for the operator; besides, it can be easily protected there from contamination, for example by means of a transparent hood 26.

The following is provided for connecting the measuring device 15 to the profile bar 13 and the area of the flow guide wall 12 on the near side of the profile bar: Extending through the tubular adjustment spindle 14 is a tubular measuring reference 19 which on its bottom end is positively connected, by means of a so-called "tube foot" 27, to the reinforcement beam 18 and, on its upper end, to a measuring housing 17. The tube foot 27 is located in the previously mentioned window 25 of the spindle foot 24. Extending through the interior of the tubular measuring reference 19 is a measuring rod 16, which by means of a compression spring 28 is kept in direct contact with the top side of the profile bar 13. The measuring rod 16 extends on it upper end into the interior of the measuring housing 17. Arranged there is an electrical measuring coil 30, and the measuring rod has there a soft iron core 29. It should be noted that the measuring housing 17 is centered in the gear casing 20*a* but relative to it easily movable in axial direction. Thus, the measuring housing 17 does not follow any deformations of the gear casing 20*a* and of the upper area of the reinforcement beam 18. It rather represents always exactly the position of the lower area of the reinforcement beam 18 on the near side of the profile bar, and of the stiff major part 12*b* of the flow guide wall 12. Also the measuring rod 16 remains entirely unaffected by the said deformations, so that the soft iron core 29 represents exactly the local position of the profile bar 13. The latter thus is measured by the measuring device 15 relative to the stiff major part 12*b* of the flow guide wall 12, in the form of an electrical signal which through lines 31 is transmitted to a remote display 32 and/or a not illustrated computer.

Additionally provided is a mechanical measured value indicator 13. It comprises a housing 34, which is positively connected to the measuring housing 17, and a movable measuring element 35. The latter is held in contact with the upper end of the measuring rod 16 by the (very small) force of a not illustrated spring (or by a not illustrated screw joint). The measured value indicator 33 operates thus with the same precision as the electrical measuring device 29, 30, 31, 32. The smallest measurable adjustment of the profile bar 13 amounts to approximately 1/1000 mm.

FIG. 1 also shows that the profile bar 13 is in known fashion forced on the outer end of the major part 12*b* of the flow guide wall 12 by means of a pressure hose 36. The latter rests in a brace plate bolted to the reinforcement beam 18. The interior of the reinforcement beam 18 is hermetically sealed from the environment by welded or bolted covers 38, 39, respectively. To extensively avoid thermal deformations of the major part 12*b* of the flow guide wall 12 and the reinforcement beam 18, a lower tempering channel 40 and an upper tempering channel 41 are provided in the interior of the reinforcement beam 18. These channels extend as well across the entire machine width; they are passed by liquid of same temperature. All of these measures make it possible to keep the reinforcement beam 18 and the major part 12*b* of the flow guide wall 12 in an isothermal state.

Figure 2:
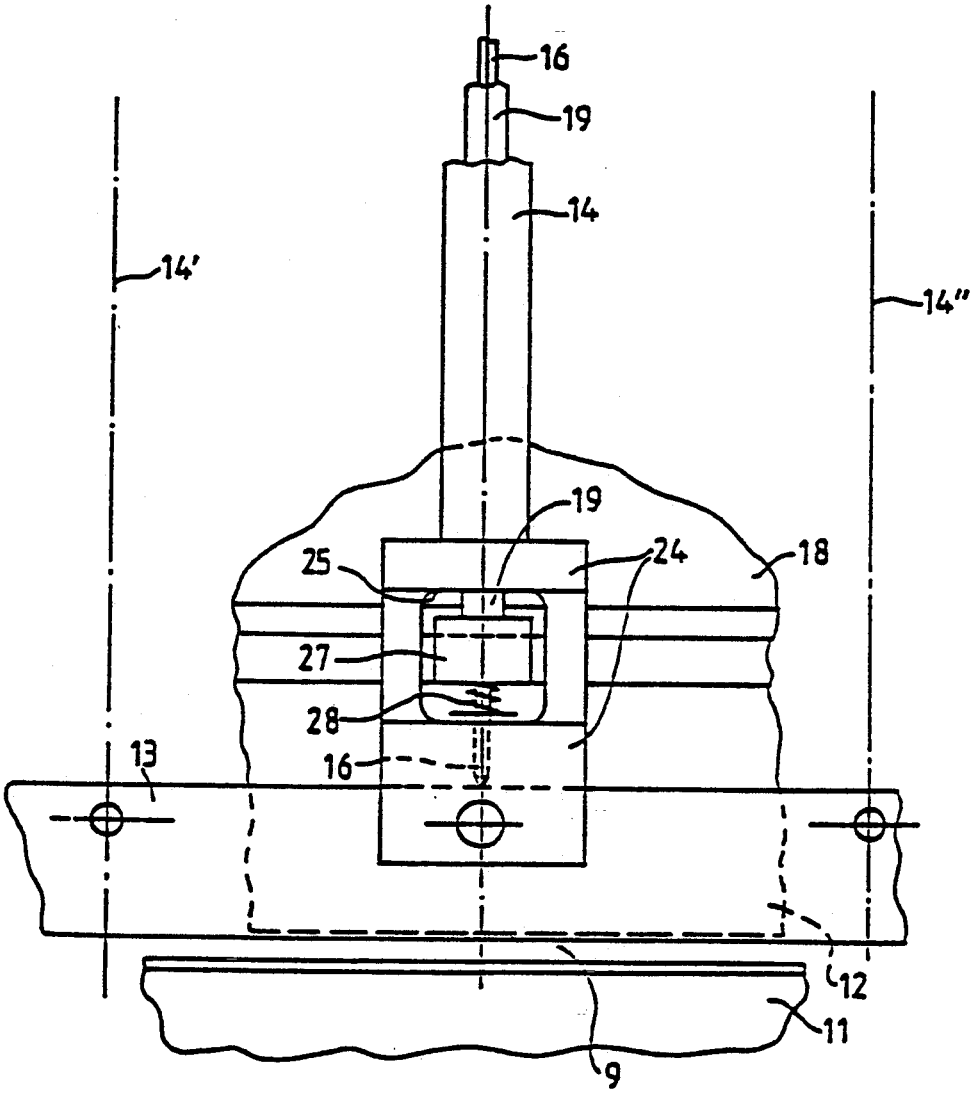
FIG. 2, a partial view in the direction of arrow II in FIG. 1.

In FIG. 2, the cover 39 and the brace plate 37 have been omitted. Illustrated is the ruler-shaped profile bar 13 and the bottom end of an adjustment spindle 14 with the spindle foot 24 (featuring a window 25). Located in the window 25 is a tube foot 27 of the measuring reference 19 and the compression spring 28, by which the measuring rod 16 is forced on the top side of the profile bar 13. Of the two adjacent spindles 14' and 14'', only the centerlines are illustrated.

I claim:

1. A headbox for a machine for the production of fiber material webs, comprising:

two flow guide walls converging to one another;

a nozzle type, machinewide stock channel, said stock channel defined by said two guide walls, said stock channel forming a machinewide stock outlet gap;

one of said two flow guide walls comprising a stiff major part and an adjustable and locally deformable slat, said slat disposed adjacent said stock outlet gap and extending across the machine width, said stiff major part having an area on a side thereof disposed near said slat;

a plurality of adjustment spindles attached to said slat, said adjustment spindles distributed across the machine width;

a spindle drive disposed on an end of each said adjustment spindle away from said slat, a plurality of measuring devices connected to said slat, said measuring devices distributed across the machine width, said measuring devices disposed away from said slat and determining the local position of said slat, each said measuring device corresponding to a respective adjustment spindle and having a measuring housing and a measuring element movable in said measuring housing;

a plurality of measuring rods, each said movable measuring element respectively connected to said slat, independently of said adjustment spindles, by way of said measuring rods; and a plurality of oblong linkage elements respectively extending parallel to each said measuring rod, each said oblong linkage element respectively connected at one end thereof to said measuring housing, and respectively connected at an other end thereof only to the area of said stiff major part on the side disposed near the slat such that said measuring housing is connected to said one flow guide wall only via said oblong linkage element.

2. The headbox of claim 1, wherein each said measuring rod extends through the interior of said respective oblong linkage element.

3. The headbox of claim 2, wherein each said oblong linkage element and each said measuring rod extend through the interior of each said respective spindle drive.

4. The headbox of claim 2, wherein each said measuring device includes a mechanical measured value indicator.

5. The headbox of claim 2, wherein each said measuring device includes an electrical signal emitter.

6. The headbox of claim 2, further comprising a mechanical measured value indictor and an electrical signal emitter.

7. The headbox of claim 1 wherein each said oblong linkage element and each said measuring rod extend through the interior of each said respective spindle.

8. The headbox of claim 1, wherein each said measuring device includes a mechanical measured value indicator.

9. The headbox of claim 1, wherein each said measuring device includes an electrical signal emitter.

10. The headbox of claim 1, further comprising a mechanical measured value indicator and an electrical signal emitter disposed on each said adjustment spindle.

11. The headbox of claim 10, wherein said measuring housing is operatively associated with a respective electrical signal emitter, and further comprising a housing for each said measured value indicator, said measured value indicator housing and said measuring housing rigidly connected with each other and with said respective oblong linkage element.

12. The headbox of claim 11, wherein said electrical signal emitter is disposed between said spindle drive and said mechanical measured value indicator, and wherein said measuring rod or an extension of said measuring rod extends up to said movable measuring element of said measuring device.

13. The headbox of claim 1, wherein said slat is ruler-shaped.

14. The headbox of claim 1, wherein each said measuring rod and each said oblong linkage element are comprised of materials having the same coefficient of thermal expansion.

15. The headbox of claim 1, wherein each said measuring rod and each said oblong linkage element are disposed in a space which is sealed and isothermal.

16. The headbox of claim 1, further comprising a plurality of spindle feet having a window, each said adjustment spindle connected to said slat by one of said spindle feet, and wherein each said oblong linkage element is connected with the area of said flow guide wall on the near side of the slat via a tube foot disposed in the window.

17. The headbox of claim 1, wherein each said oblong linkage element comprises a measuring reference.

* * * * *